US006467207B1

(12) United States Patent
Jones et al.

(10) Patent No.: US 6,467,207 B1
(45) Date of Patent: Oct. 22, 2002

(54) DISPLAY APPARATUS WITH OSCILLATION

(76) Inventors: Douglas Jones, 3500 Tachevah Dr., Palm Springs, CA (US) 92262; Gregory L. Good, 1258 Montalvo, Palm Springs, CA (US) 92262

( * ) Notice: Subject to any disclaimer, the term of this patent is extended or adjusted under 35 U.S.C. 154(b) by 0 days.

(21) Appl. No.: 09/620,920

(22) Filed: Jul. 21, 2000

(51) Int. Cl.[7] ..... G09F 11/18
(52) U.S. Cl. ..... 40/471; 40/517
(58) Field of Search ..... 40/471, 518–523, 40/592

(56) References Cited

U.S. PATENT DOCUMENTS

| | | | | |
|---|---|---|---|---|
| 3,614,727 A | * | 10/1971 | Fritts | 340/22 |
| 4,361,828 A | | 11/1982 | Hose | |
| 4,635,773 A | | 1/1987 | Llewellin | |
| 4,680,883 A | | 7/1987 | Satdjuhar et al. | |
| 4,741,118 A | | 5/1988 | Aiken et al. | |
| 4,974,354 A | | 12/1990 | Hembrook, Jr. | |
| 4,995,183 A | | 2/1991 | Aiken, Sr. | |
| 5,053,746 A | | 10/1991 | Taneo | |
| 5,132,666 A | | 7/1992 | Fahs | |
| 5,174,055 A | | 12/1992 | Aiken | |
| 5,412,892 A | * | 5/1995 | Filippakis | 40/471 |
| 5,412,893 A | | 5/1995 | Aiken, Sr. | |
| 5,500,638 A | | 3/1996 | George | |
| 5,755,050 A | * | 5/1998 | Aiken | 40/518 |
| 5,953,840 A | * | 9/1999 | Simson et al. | 40/471 |
| 6,038,800 A | * | 3/2000 | Seidel | 40/517 |
| 6,055,753 A | * | 5/2000 | Sondericker | 40/471 |
| 6,060,993 A | * | 5/2000 | Cohen | 340/691.6 |

* cited by examiner

*Primary Examiner*—Christopher P. Schwartz
(74) *Attorney, Agent, or Firm*—Sheldon & Mak; Denton L. Anderson

(57) ABSTRACT

A display apparatus has a roll of film with multiple still images disposed along the roll of film. The roll of film is scrollable by one or more electric motors to display one or more of the still images on the roll of film at a visual display location. The display apparatus is capable of oscillating desired images on display at the visual display location so as to attract the eye of the observer.

20 Claims, 4 Drawing Sheets

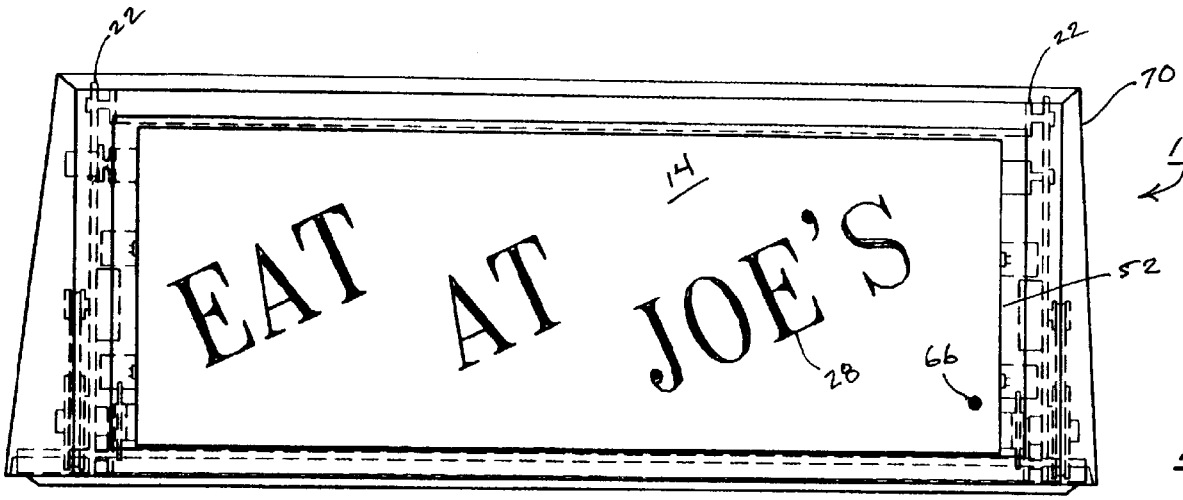
Fig. 5
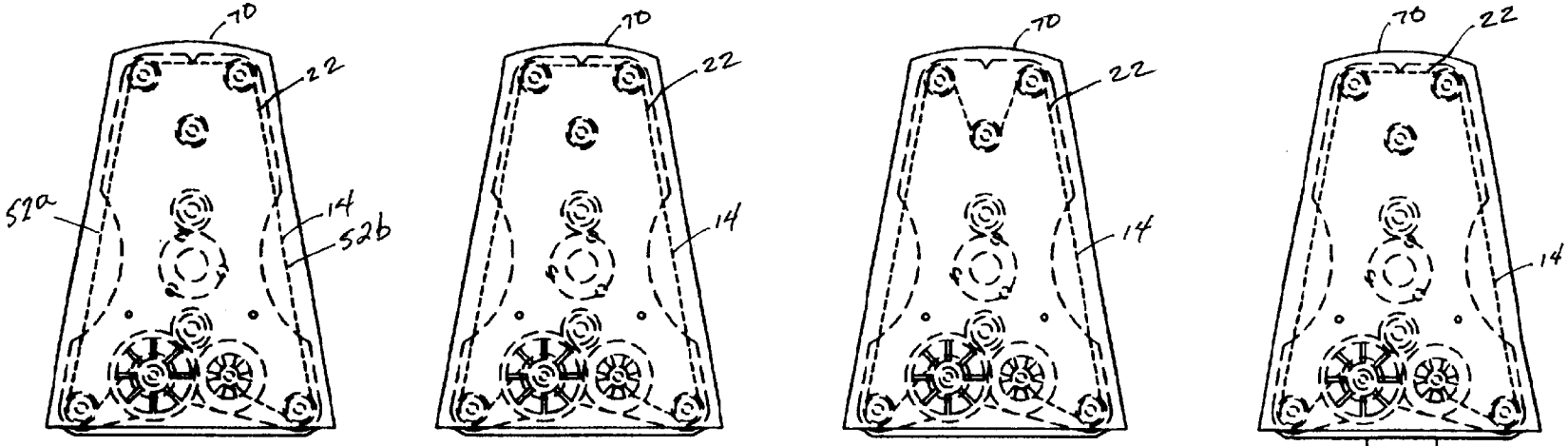
Fig. 7C
Fig. 7B
Fig. 7A
Fig. 6

DISPLAY APPARATUS WITH OSCILLATION

FIELD OF THE INVENTION

This invention relates generally to display apparatuses and, more particularly, to display apparatuses capable of displaying different images.

BACKGROUND OF THE INVENTION

Display apparatuses capable of displaying different images are becoming increasingly popular, especially as advertising devices. Using such a display apparatus, a media group can frequently change the advertisement image on display. This gives the media group the ability to advertise a client's product or services using many different images. It also gives the media group the ability to use the display apparatus to advertise the products and services of a large number of different clients.

The most cost-efficient and reliable form of such display apparatuses employ a roll of film to which has been applied a plurality of individual still images. The roll of film is disposed within a display structure having two or more vertically spaced-apart parallel rollers. The space between the rollers provides a visual image display location. When a particular still image is desired to be displayed, the film is scrolled until the desired image is properly centered within the visual display location. Typically, the roll of film is scrolled using one or more scrolling motors controlled by some form of sensor/controller.

There are several problems with presently available display apparatuses of the type described above. One problem arises from the fact that the sensor/controller typically controls the scrolling of the film by attempting to "keep track" of the relative position of each still image on the film. For example, a typical controller is programmed to note that the twelfth still image on a roll of film, is just that, the twelfth image on the roll of film. If the controller believes that the image presently being displayed at the display location is the fourth still image on the roll of film, and that the twelfth still image is desired to be displayed at the display location, the controller controls the scrolling of the film until the film is advanced by eight still images. The problem with this method of controlling the scrolling of the film is that, if the controller mistakenly believes that the image being displayed at the display location is the fifth still image (instead of the fourth still image), the controller will scroll the film only-seven still images in its attempt to place what the controller believes to be the twelfth still image within the display location. However, because the controller was "mistaken" regarding what still image was initially being displayed within the display location, the scrolling of the film by seven still images causes the eleventh still image to be displayed at the display location (not the twelfth still image). What is more, once the controller makes such a mistake as to where the film is with respect to the display location, it will remain "mistaken," until the mistake is realized by an operator.

Another problem with display apparatuses of the type described above is that the image displayed at the display location is static, and therefore does not necessarily attract attention. While the film is being scrolled to a new display image, the sign catches the eye of the observer, but once the image is properly centered at the display location, the image becomes stationary and is no longer interesting to the eye of the observer.

A third problem with such display apparatuses has to do with the most common way of braking the scrolling means to stop the scrolling of the apparatus when the desired still image has becomes properly centered within the display location. Most scrolling mechanisms employ some form of mechanical brake to slow and stop the scrolling of the film. However, mechanical brakes are prone to wear, and thus require frequent maintenance and/or replacement.

Accordingly, there is a need for a display apparatus capable of displaying different images which avoids the aforementioned problems with the prior art in an economically efficient and operationally reliable way.

SUMMARY OF THE INVENTION

The invention satisfies this need. The invention is a display apparatus comprising (a) a display structure, having a visual display location for displaying a desired still image, (b) a roll of film having at least two still images set forth thereon, each image being displayable at the visual display location, (c) scroll means for alternatively scrolling the film forwards and backwards to align a desired image at the visual display location, (d) control-means for controlling the scroll means to align a desired image at the visual display location, and (e) oscillating means for oscillating an image displayed at the visual image location.

In a preferred embodiment, the control means includes means for identifying individual still images on the film separate and apart from that still image's relative location along the length of the film.

In another preferred embodiment, the scroll means includes braking means which rely principally upon dynamic braking to slow and eventually stop the scrolling of the film.

DESCRIPTION OF THE DRAWINGS

These and other features, aspects and advantages of the present invention will become better understood with reference to the following description, appended claims and accompanying drawings where:

FIG. 5 is a side view of the display apparatus illustrated in FIG. 2, showing the addition of a roll of film and a cover shroud;

FIG. 6 is a front view of the display apparatus illustrated in FIG. 5;

FIG. 7A is a rear view of the display apparatus illustrated in FIG. 5;

FIG. 7B is an alternative rear view of the display apparatus in FIG. 5, showing the use of a fifth idler roller;

FIG. 7C is a second alternative rear view of the display apparatus in FIG. 5, showing the use of a separate oscillator;

DETAILED DESCRIPTION

Figure 1:
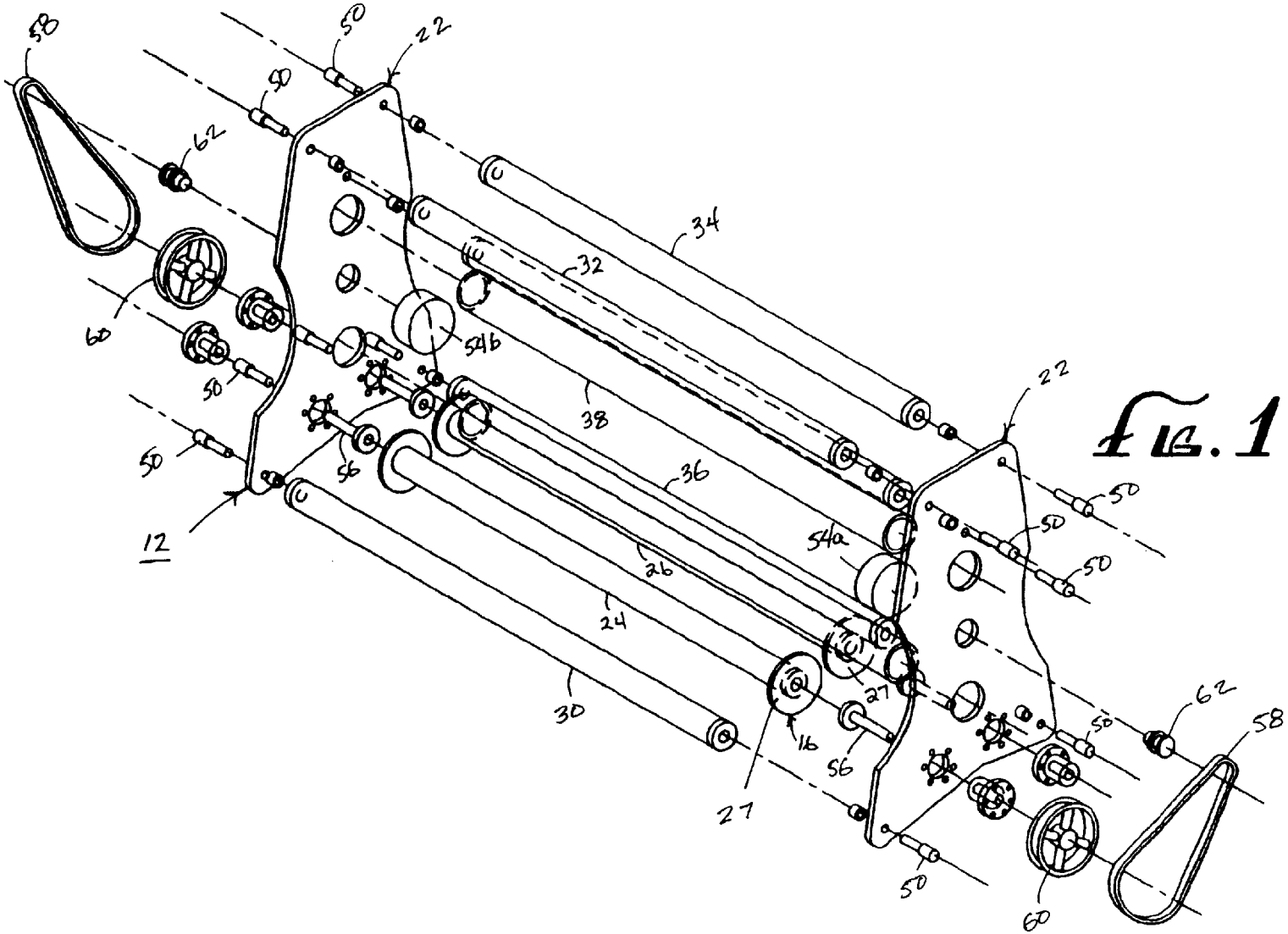
FIG. 1 is an exploded isometric view of a display apparatus having features of the invention.
Figure 2:
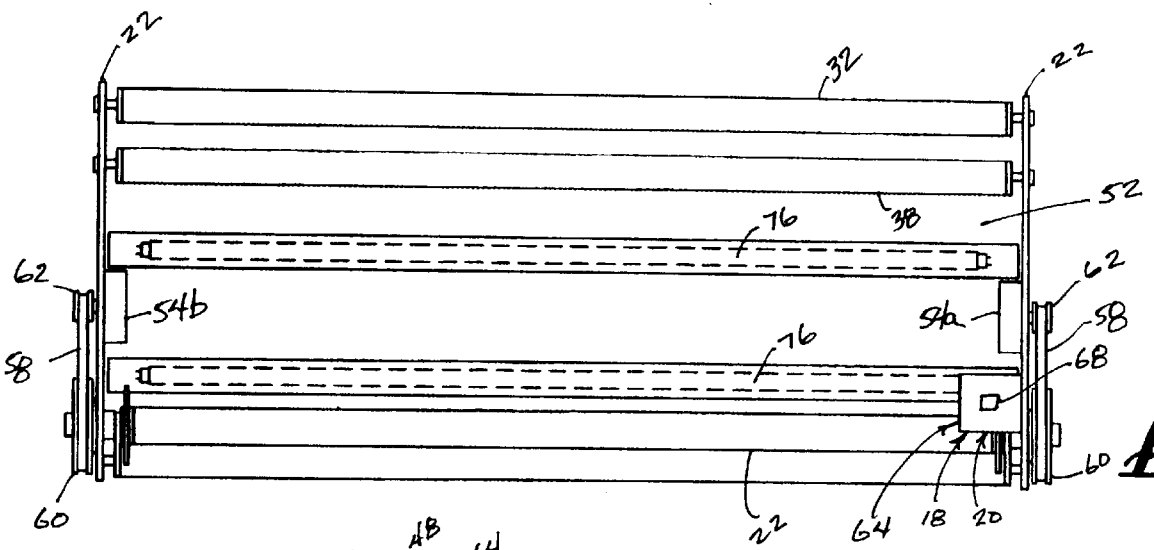
FIG. 2 is a side view of the assembled display apparatus illustrated in FIG. 1.
Figure 4:
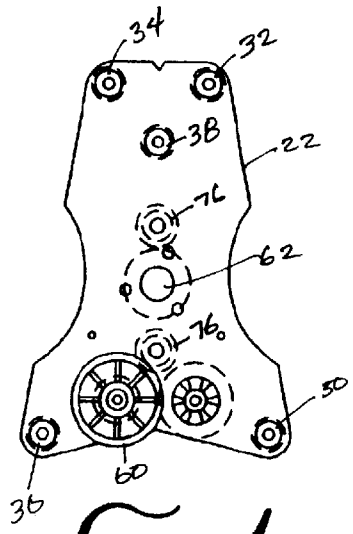
FIG. 4 is a rear view of the display apparatus illustrated in FIG. 2.
Figure 3:
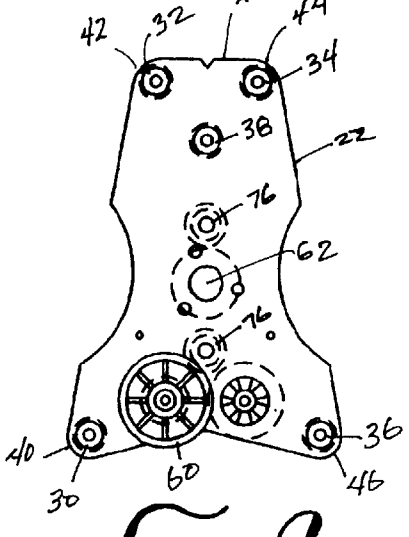
FIG. 3 is a front view of the display apparatus illustrated in FIG. 2.
Figure 9:
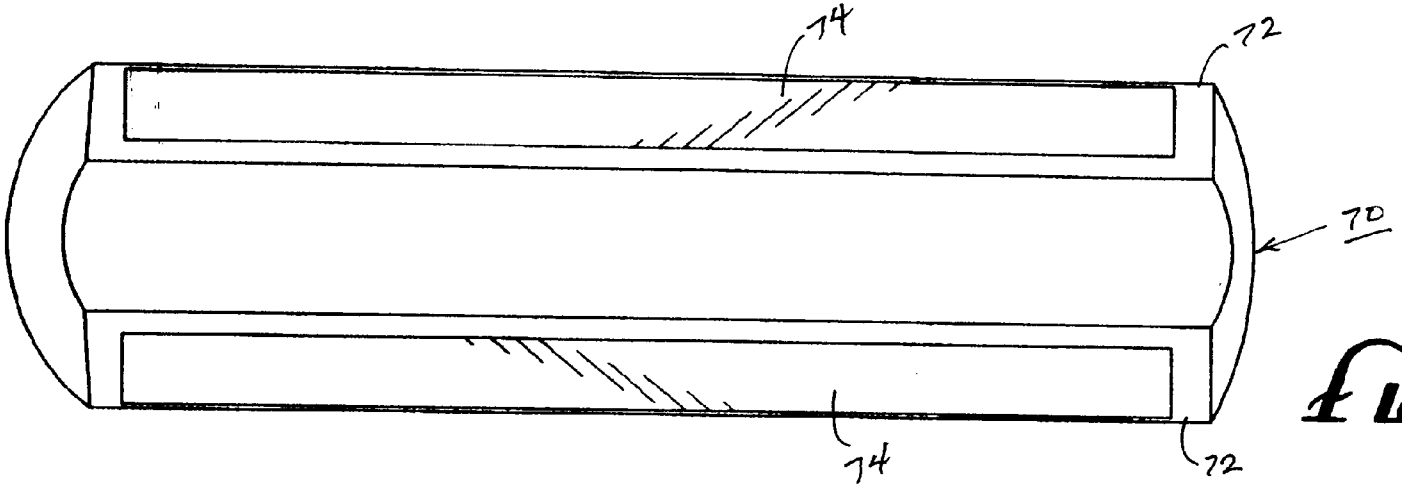
FIG. 9 is a top view of the cover shroud illustrated in FIG. 8.
Figure 8:
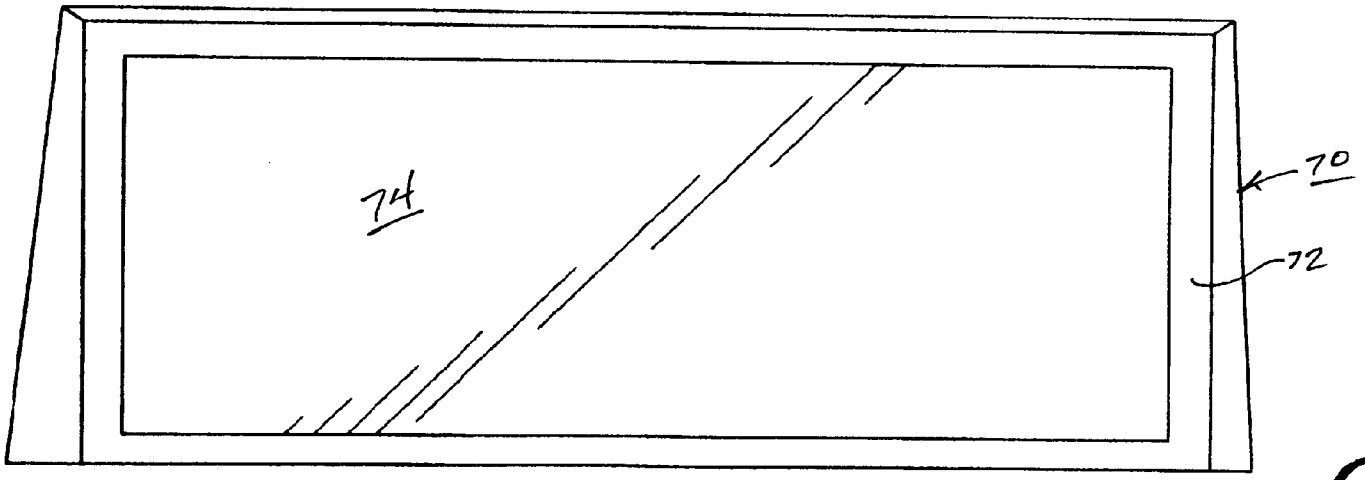
FIG. 8 is a side view of a cover shroud useable in the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a display apparatus 10 comprising a display structure 12, a roll of film 14 carrying a plurality of still images 28, scroll means 16 for scrolling the film, control means 18 for controlling the scroll means 16 and oscillating means 20 for oscillating and the display of one of the still images 28.

The roll of film 14 has at least two still images 28 disposed thereon, more typically, at least 10 still images 28, and frequently more than 30 still images 28.

In the embodiment illustrated in the drawings, the display structure 12 comprises a pair of support members 22. The support members 22 can be opposed plates, typically made from a lightweight metal such as a thin steel.

The roll of film 14 has a first end and an opposed second end. The first end is attached to a first take-up spool 24 and is partially wound around the first take-up spool 24. The second end is attached to a second take-up spool 26 and is partially wound around the second take-up spool 26. Each take-up spool 24 or 26 has a spool flange 27 disposed at each of its opposed two ends to retain the film on the take-up spool 24 or 26. The first take-up spool 24 and the second take-up spool 26 are disposed in parallel and are both supported at their opposite ends by the two support members 22.

In the embodiment illustrated in the drawings, the support members 22 are vertical and the take-up spools 24 and 26 are horizontal. In an alternative embodiment, the support members 22 are horizontal while the take-up spools 24 and 26 are vertical.

In the embodiment illustrated in the drawings, the display structure 12 further comprises five idler rollers, a first idler roller 30, a second idler roller 32, a third idler roller 34, a fourth idler roller 36 and a fifth idler roller 38. Each of the idler rollers 30, 32, 34, 36 and 38 is disposed in parallel with the two take-up rollers 24 and 26, and are all supported at their opposite ends by the two support members 22. The first idler roller 30 is disposed at a first lower corner 40 of each support member 22. The second idler roller 32 is disposed at a first upper corner 42 of each support member 22. The third idler roller 34 is disposed at a second upper corner 44 of each support member 22. The fourth idler roller 36 is supported at a second lower corner 46 of each support member 22. The fifth idler roller 38 is disposed along the vertical center line of each support member 22, several inches below the uppermost edge 48 of each support member 22. Each of the idler rollers 30, 32, 34, 36 and 38 is attached to the vertical support members 22 by stationary mounting pins 50 which allow the idler rollers 30, 32, 34, 36 and 38 to freely rotate about their vertical axes.

The idler rollers 30, 32, 34, 36 and 38 are adapted to support the roll of film 14 between the first take-up spool 24 and the second take-up spool 26. The idler rollers 30, 32, 34, 36 and 38 are further adapted to provide for smooth scrolling of the roll of film 14 between the first take-up spool 22 and the second take-up spool 24, and to provide at least one visual display location 52. In the embodiment illustrated in the drawings, the roll of film 14 is disposed between the first take-up roller 24, the first idler roller 30, the second idler roller 32, the third idler roller 34, the fourth idler roller 36 and the second take-up spool 26. The idler rollers 30, 32, 34, 36 and 38 provide a pair of visual display locations, a first visual display location 52*a* and a second visual display location 52*b*. The area of the display apparatus 10 between the first idler roller 30 and the second idler roller 32 defines the first visual display location 52*a*, and the area between the third idler roller 34 and the fourth idler roller 36 defines the second visual display location 52*b*. In this configuration, the film 14 is held taut between the first idler roller 30 and the second idler roller 32 to allow a still image to be easily viewed in the first visual display location 52*a*. Similarly, the roll of film 14 is held taut between the third idler roller 34 and the fourth idler roller 36 to allow a second desired still image to be easily viewed at the second visual display location 52*b*. By this configuration, two different visual images 28 can be displayed back to back within the display structure 12 at the same time.

In the embodiment illustrated in the drawings, the fifth idler roller 38 is an optional idler roller, only used in special circumstances. Normally, the fifth idler roller 38 is not used at all. However, where accentuated oscillation of still images 28 at the visual display location 52 is desired, or when oversized images 28 are used, the fifth idler roller 38 can be used to provide proper oscillation. Without the use of the fifth idler roller 38, accentuated oscillation and/or the use of elongated still images 28 could result in the undesired oscillation of a still image 28 from one of the visual display locations 52 onto the other visual display location 52.

The scroll means 16 are typically provided by at least one motor 54 for driving the first take-up spool 24 and the second take-up spool 26, so that the roll of film 14 can be alternatively rolled forwards and backwards between the first take-up spool 24 and the second take-up spool 26. In a typical embodiment, the at least one motor 54 is a non-servo, direct current motor. In the embodiment illustrated in the drawings, the scroll means 16 are provided by two motors, a first motor 54*a* and a second motor 54*b*. The first motor 54*a* is adapted to drive and brake the first take-up spool 24 and the second motor 54*b* is adapted to drive and brake the second take-up spool 26. Each motor 54 is operatively attached to one of the take-up spools 24 or 26 via a drive pin 56, and a drive belt 58 disposed between a motor pulley 60 and a take-up spool pulley 62.

Preferably, the at least one motor 54 is braked by non-mechanical dynamic braking means. By the term "dynamic braking," it is meant using the electromagnetic force of the motor 54 to brake the rotation of the take-up spools 24 and 26. As noted above, in the embodiment illustrated in the drawings, the first motor 54*a* drives the first take-up spool 24 and the second motor 54*b* drives the second take-up spool 26. When it is desired to advance the roll of film 14 from the first take-up spool 24 to the second take-up spool 26, the second motor 54*b* drives the second take-up spool 26 to wind additional film onto the second take-up spool 26. At the beginning of this operation, the first motor 54*a* is disengaged. As the amount of additional desired film is rolled onto the second take-up spool 26, the first motor 54*a* is engaged to provide a drag force on the first take-up spool 24. By this dynamic braking operation, two things occur. First of all, the rotation of the second take-up spool 26 is slowed and eventually brought to a halt. Secondly, once the film 14 is brought to a halt, the film 14 is held against the idler rollers 30, 32, 34, 36 and 38 in a taut configuration. Holding the film 14 taut facilitates the display of desired still images 28 at the visual display locations 52.

The control means 18 operates to control the scroll means 16 to align a desired image 28 at a visual display location 52 . In the embodiment illustrated in the drawings, the control means 18 is provided by a controller 64 for controlling both the first motor 54*a* and the second motor 54*b*.

The controller 64 preferably comprises a central processing unit capable of accepting and responding to commands from the user and capable of storing a set of preprogrammed commands and operating criteria.

In a preferred embodiment, at least one image marker 66 is disposed proximate to each image 28 on the roll of film 14, and the controller 64 further comprises a sensor 68 for identifying each image 28 on the roll of film 14 by sensing each-image marker 66. In this preferred design, the controller 64 is capable of identifying each image 28 on the roll of film 14 independent of the relative location of that image 28 on the roll of film 14. The image markers 66 can also be used to identify the lower or upper edge of a still image 28 being displayed at the visual display location 52, so as to allow the controller 64 to properly center the still image 28 at the visual display location 52 and so as to facilitate the proper oscillation of the, still image 28 at the visual display location 52.

In a still further preferred design, each image marker 66 is sequentially numbered or otherwise identified with respect to adjacent image markers 66. By this design, the controller 64 can be programmed to scroll the roll of film 14 rapidly when the distance between the present location of the film 14 and a desired still image 28 is great, and to slow down the scrolling speed as the desired still image 28 is approached. In the embodiment illustrated in the drawings, one or more of the idler rollers 30, 32, 34, 36 and 38 has an externally protruding gear 68 which can be meshed with an engagement gear from a tachometer (not shown) operatively connected to the controller 64. The tachometer can be used to continuously monitor the scrolling speed of the roll of film 14.

Preferably, the controller 64 further comprises a radio frequency receiver for receiving remote instruction signals regarding the operation of the display apparatus 10. Most preferably, the controller 64 further comprises a radio frequency receiver/transmitter for both receiving remote instruction signals regarding the operation of the display apparatus 10 and for transmitting signals confirming the-operation of the display apparatus 10.

It is also preferable that the controller 64 further comprise a clock which enables the controller 64 to control the scroll means to provide differerent images 28 at the visual display location 52 based upon the time of day. For example, the controller 64 can control the scroll means to advertise childrens products during daylight hours and adult products during late evenings hours.

In another embodiment of the invention, the controller 64 comprises GPS information receiving means for determining the location of the display apparatus using a global positioning satellite. With this capability, the controller 64 can be programmed to display different desired images 28 at the visual display locations 52, depending upon the physical location of the display apparatus 10. This is an important feature for display apparatuses 10 mounted upon motor vehicles, such as taxi cabs. For example, a taxi cab operating-in both English-speaking neighborhoods and Spanish-speaking neighborhoods can effectively used the display apparatus of the invention to automatically display advertising images. in the appropriate language, depending upon the location of the taxi cab.

In another embodiment of the invention, the controller 64 further-comprises weather-sensing means for detecting weather parameters proximate to the display apparatus location. With this feature, the controller 64 can be programmed to automatically shift the emphasis of advertisements displayed at the visual display location 52 depending upon weather conditions. For example, sun block advertisements can be withdrawn in favor of umbrella advertisements as weather conditions in the location of the display apparatus 10 changes from sunny weather to rainy weather.

In the embodiment illustrated in the drawings, the oscillating means 20 are provided by the scroll means 16 and the control means 18. The controller 64 is preprogrammed to control the scroll means 16 to vertically oscillate a desired image 28 being displayed at both the first visual display location 52*a* and the second visual display location 52*b* by slowly scrolling the film 14 upwards and downwards while maintaining the desired images 28 within each of the two visual display locations 52*a* and 52*b*. In a typical embodiment wherein the images 28 on the roll of film 14 are about 8 inches in height, the oscillating of the images 28 is accomplished by slowly scrolling the film 14 upwards and downwards a distance of about 4 inches in each direction. Where greater oscillation is desired, the images 28 on the roll of film 14 are separated by a greater distance and the film 14 is further threaded from the second idler roller 32 under the fifth idler roller 38 before being threaded over the fourth idler roller 36 as illustrated in FIG. 7B. This provides the roll of film 14 with the additional distance necessary for extended oscillation distances.

In the alternative embodiment wherein the take-up spools 24 and 26 and the idler rollers 30, 32, 34, 36 and 38 are disposed vertically, instead of horizontally, the oscillating means 18 is adapted to oscillate images within the visual display location 52 horizontally, instead of vertically.

The oscillating means 20 can also comprise a separate oscillator 69 as illustrated in FIG. 7C. In one embodiment, the oscillator 69 is adapted to physically oscillate the entire display structure 12. Such an oscillator 69 can be used to oscillate the visual display location 52 vertically, horizontally, diagonally or in a combination of these directions.

In the embodiment illustrated in the drawings, the invention further comprises a cover shroud 70 for enclosing the display structure 12 to insulate the sensitive components of the display apparatus 10 from wind, rain, dust, etc. The cover shroud 70 has opposed transparent sidewalls 72 which provide display windows 74 at the first and second image display locations 52. Where appropriate, the cover shroud 70 can be attached to an undercarriage plate (not shown). In the embodiment illustrated in the drawings, the cover shroud 70 is aerodynamically shaped to minimize drag when the display apparatus 10 is installed upon a vehicle.

Preferably, the display apparatus 10 further comprises a light source 76 disposed within the display structure 12 for illuminating desired images 28 at the visual display locations 52. In the embodiment illustrated in the drawings, the light source 76 comprises two horizontally disposed light bulbs located within the display structure 12 behind both-the first visual display location 52*a* and behind the second visual display-location 52*b*. By this design, the light source 76 is thereby capable of "backlighting" desired images 28 at both the first visual display location 52*a* and the second visual display location 52*b*, so that the desired images 28 can be readily seen at night or in darkened indoor locations.

As suggested above, the display apparatus 10 of the invention is ideal for mounting atop a vehicle, such as a motor vehicle (e.g. a taxi cab), trailer or boat.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A display apparatus comprising:

(a) a display structure, having a visual display location for displaying a desired still image;

(b) a roll of film having at least two still images set forth thereon, each image being displayable at the visual display location, the roll of film having a first end attached to a first take-up spool and a second end attached to a second take-up spool;

(c) at least one motor for driving the first take-up spool and the second take-up spool so that the roll of film can be alternatively rolled forwards and backwards between the first take-up spool and the second take-up spool; and (d) a controller for controlling the at least one motor, the controller being capable of controlling the at least one motor to scroll the roll of film to display a desired image at the visual display location, and the controller being capable of controlling the at least one motor to oscillate an image displayed at the visual image location.

2. The display apparatus of claim 1 wherein the at least one motor comprises a first motor for driving the first take-up spool and a second motor for driving the second take-up spool.

3. The display apparatus of claim 2 wherein the takeup spools are dynamically braked.

4. The display apparatus of claim 1 wherein the display structure has at least two visual display locations.

5. The display apparatus of claim 4 wherein the at least two visual display locations are disposed back-to-back.

6. The display apparatus of claim 1 further comprising an oscillator for oscillating a desired image at the visual display location.

7. The display apparatus of claim 6 wherein the film has a front side upon which images are appended and a back side, and wherein a light source is located within the display structure so as to project light against the back side of the film when the film is displaying a desired image at the visual display location.

8. The display apparatus of claim 1 wherein the roll of film comprises an image marker disposed proximate to each image on the roll of film, and wherein the controller further comprises a sensor for identifying each image on the roll of film by sensing each image marker.

9. The display apparatus of claim 1 wherein the visual display location comprises a lower roller and a spaced-apart upper roller, and wherein the desired image is disposed between the lower roller and the upper roller.

10. The display apparatus of claim 1 further comprising image identifying means for identifying individual images on the roll of film independent of each individual image's position on the roll of film.

11. The display apparatus of claim 1 wherein the controller includes a clock and the controller is capable of controlling the at least one motor for the display of images at the visual display location based upon the time of day.

12. The display apparatus of claim 1 wherein the roll of film comprises at least ten still images displayed thereon.

13. The display apparatus of claim 1 wherein the controller is capable of controlling the at least one motor to vertically oscillate an image displayed at the visual image location.

14. The display of claim 1 wherein the display apparatus is affixed to a motor vehicle.

15. The display apparatus of claim 1 further comprising a sensor capable of identifying individual images on the roll of film independent of each image's relative position on the film.

16. The display apparatus of claim 1 wherein the controller includes gps information means for determining the location of the display apparatus using a global positioning satellite.

17. The display apparatus of claim 1 wherein the controller includes weather sensor means for detecting weather parameters at the display apparatus.

18. The display apparatus of claim 1 further comprising at least one idler roller disposed in contact with the roll of film between the first take-up spool and the second take-up spool.

19. A display apparatus comprising:

(a) a display structure, having a pair of visual display locations disposed back-to-back for simultaneously displaying a pair of desired still images;

(b) a roll of film having at least ten still images set forth thereon, each image being displayable at the visual display location, the roll of film having a first end attached to a first take-up spool and a second end attached to a second take-up spool;

(c) at least one idler roller disposed in contact with the roll of film, the idler roller being located spaced apart from the first take-up spool and the second take-up spool proximate to the visual display location;

(d) at least one motor for driving the first take-up spool and the second take-up spool so that the roll of film can be alternatively rolled forwards and backwards between the first take-up spool and the second take-up spool;

(e) an image marker disposed proximate to each image on the roll of film;

(f) a controller for controlling the at least one motor, the controller being capable of controlling the at least one motor to scroll the roll of film to display a desired image at the visual display location, the controller comprising a sensor for identifying each image on the roll of film by sensing each image marker, and the controller also being capable of controlling the at least one motor to vertically oscillate an image displayed at the visual image location, the controller further comprising a clock and the controller being capable of controlling the at least one motor for the display of images at the visual display location based upon the time of day;

wherein the film has a front side upon which images are appended and a back side, and wherein a light source is located within the display structure so as to project light against the back side of the film when the film is displaying a pair of desired images at the visual display location.

20. A display apparatus comprising:

(a) a display structure, having a visual display location for displaying a desired still image;

(b) a roll of film having at least two still images set forth thereon, each image being displayable at the visual display location;

(c) scroll means for alternatively scrolling the film forwards and backwards to align a desired image at the visual display location;

(d) control means for controlling the scroll means to align a desired image at the visual display location; and (e) oscillating means for vertically oscillating an image displayed at the visual image location.

* * * * *